US008196348B2

(12) United States Patent
Flannery

(10) Patent No.: US 8,196,348 B2
(45) Date of Patent: Jun. 12, 2012

(54) GATED HEIGHT ADJUSTABLE BARRIER

(75) Inventor: Mark A. Flannery, Longboat Key, FL (US)

(73) Assignee: Carlson Pet Products, Inc., Longboat Key, FL (US)

( * ) Notice: Subject to any disclaimer, the term of this patent is extended or adjusted under 35 U.S.C. 154(b) by 1167 days.

(21) Appl. No.: 12/001,538

(22) Filed: Dec. 12, 2007

(65) Prior Publication Data

US 2008/0202047 A1 Aug. 28, 2008

Related U.S. Application Data

(60) Provisional application No. 60/903,236, filed on Feb. 22, 2007.

(51) Int. Cl.
*E06B 3/68* (2006.01)

(52) U.S. Cl. ..... 49/55; 49/57; 49/465

(58) Field of Classification Search ..... 49/50, 55, 49/57, 463, 465
See application file for complete search history.

(56) References Cited

U.S. PATENT DOCUMENTS

| | | | | | |
|---|---|---|---|---|---|
| 683,217 | A | * | 9/1901 | Mower | 49/55 |
| 2,459,884 | A | * | 1/1949 | Kopf | 160/223 |
| 2,645,789 | A | * | 7/1953 | Wisner, Jr. | 5/94 |
| 2,803,074 | A | * | 8/1957 | Brokish | 49/450 |
| 4,026,070 | A | * | 5/1977 | Hicks | 49/55 |
| 4,111,217 | A | | 9/1978 | Victor | |
| 4,437,265 | A | * | 3/1984 | Turro et al. | 49/57 |
| 4,465,262 | A | | 8/1984 | Itri et al. | |
| 4,475,309 | A | * | 10/1984 | Porter | 49/55 |
| 4,624,072 | A | * | 11/1986 | Zilkha | 49/55 |
| 4,628,635 | A | * | 12/1986 | Maillard | 49/55 |
| 4,671,012 | A | * | 6/1987 | Merklinger et al. | 49/55 |
| 4,685,247 | A | * | 8/1987 | Alam | 49/55 |
| 4,817,334 | A | * | 4/1989 | Badger et al. | 49/55 |
| 4,937,975 | A | * | 7/1990 | Zilkha | 49/56 |
| 5,020,834 | A | * | 6/1991 | Zilkha | 292/74 |
| 5,446,996 | A | * | 9/1995 | Lamont | 49/57 |
| 5,461,827 | A | | 10/1995 | Lofton | |
| 5,860,250 | A | * | 1/1999 | Hill et al. | 49/397 |
| 6,112,460 | A | * | 9/2000 | Wagnitz | 49/55 |
| 6,178,693 | B1 | | 1/2001 | Hunt | |
| 6,293,172 | B1 | | 9/2001 | Smith | |
| 6,655,087 | B2 | * | 12/2003 | Andersen | 49/55 |
| 7,441,370 | B2 | * | 10/2008 | Muller | 49/57 |
| 7,975,431 | B2 | * | 7/2011 | Flannery | 49/57 |
| 2001/0000556 | A1 | | 5/2001 | Rossman et al. | |
| 2002/0157316 | A1 | * | 10/2002 | Andersen | 49/55 |
| 2008/0256865 | A1 | * | 10/2008 | Trujillo et al. | 49/55 |
| 2008/0307708 | A1 | * | 12/2008 | Quan | 49/55 |

FOREIGN PATENT DOCUMENTS

| | | | | |
|---|---|---|---|---|
| GB | 2275492 | A | * | 8/1994 |
| WO | WO 9014489 | A1 | * | 11/1990 |

* cited by examiner

*Primary Examiner* — Jerry Redman

(57) ABSTRACT

A barrier or partition for the inside of a house having upper and lower barrier sections that are adjustable relative to each other such that the barrier as a whole is adjustable in height. The upper and lower barrier sections have paired vertically extending support members that slide relative to each other. At least one pair of vertically extending support members have a pincher or pincher mechanism that squeezes upon one of the vertically extending support members to fix the vertically extending support members in a nonsliding fashion relative to each other. The barrier includes a gate that also includes upper and lower sections and paired vertically extending support members that slide relative to each other. Further upper and lower sections, with or without gates, may be laterally attached or detached to increase or decrease a length of the barrier.

19 Claims, 3 Drawing Sheets

GATED HEIGHT ADJUSTABLE BARRIER

FIELD OF THE INVENTION

The present invention relates generally to a fence-like partition for an inside of a house, more particularly to such a partition having a gate, and specifically to an in-house gated partition or safety barrier that is height adjustable along the entire length of the partition.

BACKGROUND OF THE INVENTION

A gate for the inside of a house may be placed at the top of a staircase, at the bottom of a staircase, at the entry way to the kitchen, at the exits to a living room, or at some other location in the house to control access to and from certain areas of the house. Some gates are big. Other gates are small. However, families change. Children grow. Dogs have puppies. Thus, over time, different gates are purchased and some gates are stored in the garage, never to be used again.

SUMMARY OF THE INVENTION

A feature of the present invention is the provision in height adjustable barrier, of a lower barrier section having a lower set of lower vertically extending support members and an upper barrier section having an upper set of upper vertically extending support members, with each of the upper vertically extending support members aligned with and slideably engaging one of the lower vertically extending support members.

Another feature of the present invention is the provision in such a height adjustable barrier, of a gate in the lower and upper barrier sections.

Another feature of the present invention is the provision in a such a height adjustable barrier, of a release connection between at least one vertically extending support member and the lower vertically extending support member with which said at least one vertically extending support member is aligned, wherein said quick release connection fixes the lower barrier section relative to the upper barrier section such that the lower barrier section is not slideable relative to the upper barrier section until the quick release connection is released.

Another feature of the present invention is the provision in such a height adjustable barrier, of a gate lower barrier section having a lower set of lower vertically extending support members and a gate upper barrier section having a upper set of upper vertically extending support members, with each of the upper vertically extending support members of the gate upper barrier section aligned with and slideably engaging one of the lower vertically extending support members of the gate lower barrier section.

Another feature of the present invention is the provision in such a height adjustable barrier, of one of said lower and upper vertically extending support members including a tube and the other of said lower and upper vertically extending support members being slideable in said tube.

Another feature of the present invention is the provision in such a height adjustable barrier, of a pincher or pinch mechanism between at least one pair of the pairs of lower and upper vertically extending support members that are paired with each other such that the upper and lower barrier sections are slideable vertically relative to each other when the pincher is engaged and are not slideable vertically relative to each other when the pincher is disengaged.

Another feature of the present invention is the provision in such a height adjustable barrier, of a slippery sleeve between at least some of the pairs of upper and lower vertically extending support members to enhance slideability between the upper and lower barrier sections.

Another feature of the present invention is the provision in such a height adjustable barrier, of another lower barrier section and another upper barrier section, with said lower barrier sections being engaged to each other, and with said upper barrier sections being engaged to each other, such that the height adjustable barrier is extendable in length or lateral direction.

Another feature of the present invention is the provision in such a height adjustable barrier, of a lower horizontally extending support member engaging and spacing apart lower vertically extending support members, of an upper horizontally extending support member engaging and spacing apart upper vertically extending support members, and of a medial horizontally extending support member engaging one of the lower and upper barrier sections and engaging and spacing apart the vertically extending support members of such barrier section.

An advantage of the present invention is that the barrier is adjustable in height. The height adjustable barrier may be placed at a certain height pursuant to a particular place in the house, pursuant to a particular family having infants, small children or teenagers, or pursuant to other factors. Moreover, as children or dogs grow, a new gate need not be purchased.

Another advantage of the present invention is that the gate in the height adjustable barrier is adjustable in height along with, and at the same time as, all sections of the barrier or barriers.

Another advantage of the present invention is that the height adjustable barrier is also adjustable in length to reach between relatively narrow or relatively wide doorways or points of access.

Another advantage of the present invention is that the height adjustable barrier is quickly, readily and easily adjustable in height.

Another advantage of the present invention is that the height adjustable barrier is safe and sturdy whether the barrier is in a lowered position or a raised position. One feature contributing to this advantage is the relatively long or relatively elongated overlap between the upper and lower vertically extending support members when the barrier is in the raised position. Another feature contributing to this advantage is the provision of a sleeve between the upper and vertically extending support members that permits a true and tight fit between the upper and lower vertically extending support members while permitting an easy and relatively slippery sliding between the upper and lower vertically extending support members. Another feature contributing to this advantage is the medial horizontally extending support member disposed between the upper and lower horizontally extending support members.

Another advantage of the present invention is that the height adjustable barrier is relatively inexpensive to manufacture.

Another advantage of the present invention is that the height adjustable barrier may be set at an infinite number of heights. The vertically extending support members are slideable relative to each other and are thus incrementally adjustable relative to each other.

DESCRIPTION

Figure 1:
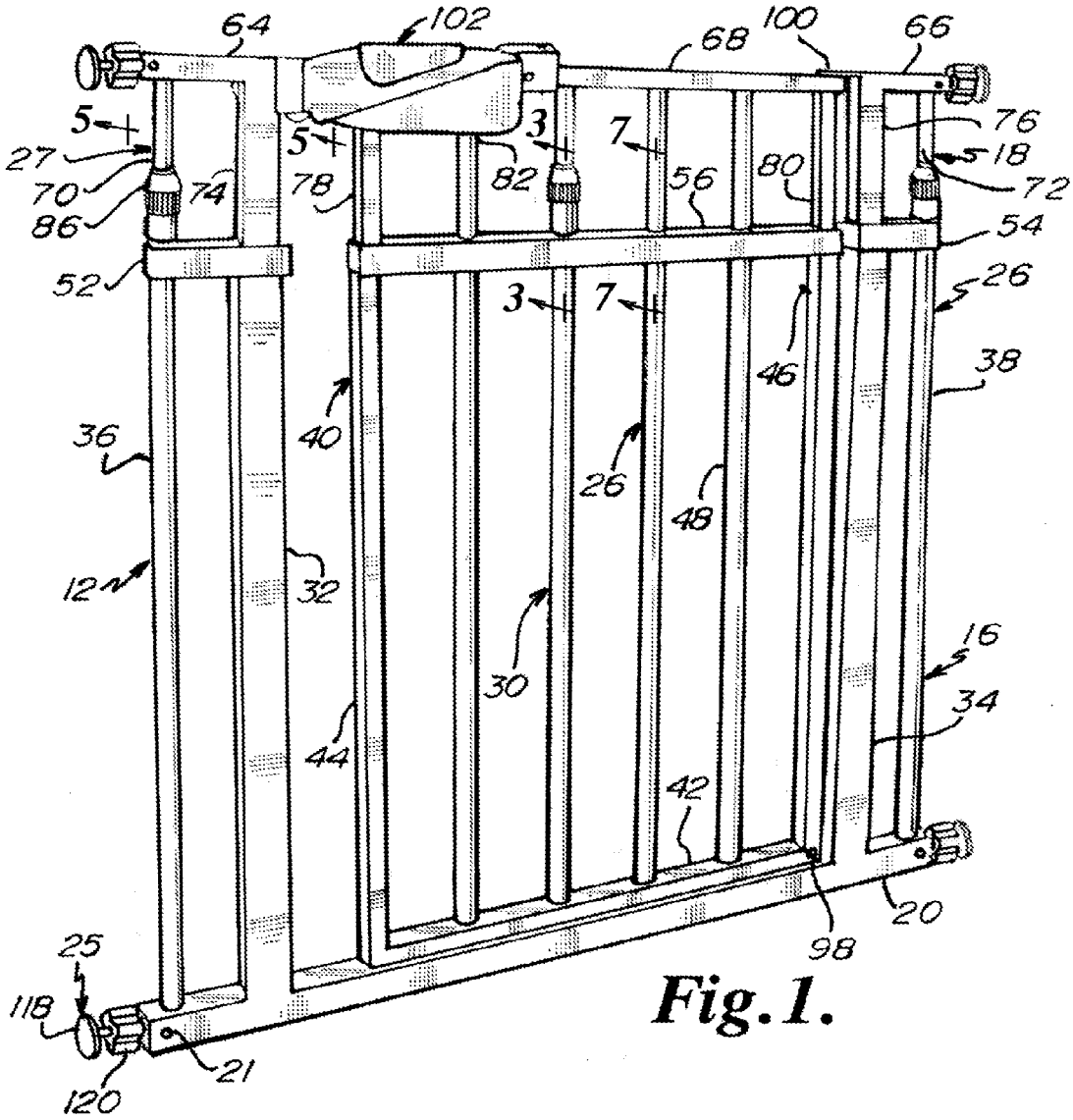
FIG. 1 is a perspective view of the present gated height adjustable barrier.

FIG. 1 shows a gated height adjustable barrier 12. Barrier 12 includes a lower barrier section 16 and an upper barrier section 18. Barrier 12 includes a height direction, a length direction, and a width direction, with all such directions being normal to each of the other two directions.

Figure 6:
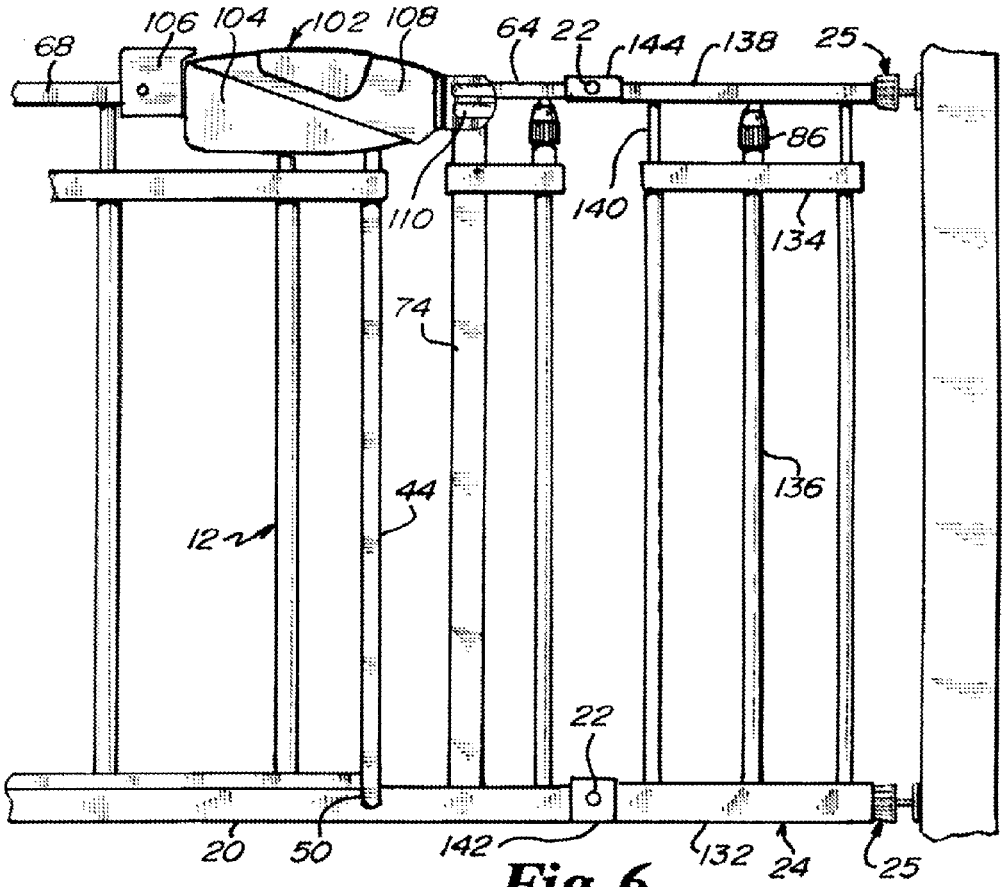
FIG. 6 is a side, partial view of the gated height adjustable barrier of FIG. 1 that further includes a barrier extension having upper, lower, and medial horizontally extending support members and upper and lower vertically extending support members.

Lower barrier section 16 includes a lower horizontally extending support member 20. Member 20 is a metal tube, generally rectangular in section. Member 20 includes, at each of its end portions, a through hole 21 extending through member 20 in the width direction. As shown in FIG. 6, member 20 can receive a pin connector 22 for engaging a height adjustable barrier 24 that does not include a gate. Member 20 further includes at and centered in each of its end faces, a threaded opening extending in the length direction for engaging a horizontally adjustable extension 25.

Lower barrier section 16 further includes a set of lower vertically extending support members 26 engaged to, such as by welding, the lower horizontally extending support member 20. Each of the lower vertically extending support members 26 engage therein an upper vertically extending support member 27 depending from the upper barrier section 18.

Figure 7:
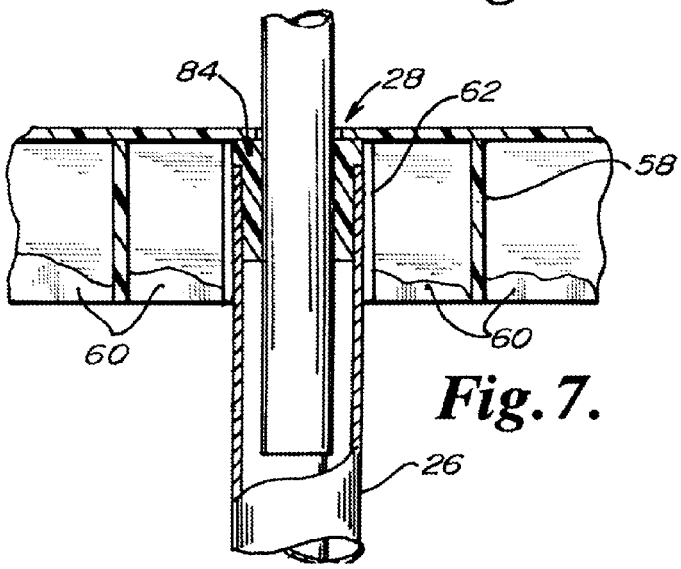
FIG. 7 is a detail, side, partially section view, at lines 7-7 of FIG. 1, showing a slippery sleeve that permits easy sliding of the upper and lower vertically extending support members and that contributes to the stability of the upper and lower vertically extending support members relative to each other.

Lower vertically extending support member 26 is tubular and includes an upper open end 28, as shown in FIG. 7. Two of the lower vertically extending support members 26 confront opposite sides of a swingable gate 30. As shown in FIG. 1, these two members 26 are indicated by reference numbers 32, 34 and can be referred to as lower vertically extending base support members 32, 34. These base support members 32, 34 are rectangular in section and are relatively large, and are about the size of the lower horizontally extending support member 20. Two other of the lower vertically extending support members 26 are indicated by reference numbers 36, 38 and can be referred to as lower vertically extending end support members 36, 38. End support members 36, 38 are cylindrical in shape.

Lower barrier section 16 further includes a lower gate barrier section 40 having a lower horizontally extending gate support member 42, and a set of lower vertically extending support members 26, of which two are gate end support members 44, 46 and of which the remaining four are inner cylindrical support members 48. Support members 44, 46 are generally square in section. Gate end support member 44 has a downwardly projecting tab 50, shown in FIG. 6, that confronts and makes contact with a side face of the lower horizontally extending support member 20 to stop the gate 30 from swinging fully through a plane of the barrier 12. Gate end support member 46 is pivotally joined along a vertical axis at a lower end to horizontally extending support member 20 such that gate 30 swings on such vertical axis defined generally by gate end support member 46.

Lower barrier section 16 further includes first, second and third medial horizontally extending support members 52, 54, 56. First and second end members 52, 54 are disposed at the ends of the lower barrier section 16 and third member 56 is disposed therebetween in the gate 30. Support members 52, 54, 56 are disposed in line or on a straight line with each other. Each of the members 52, 54, 56 fixedly engages the upper ends or end portions of their respective lower vertically extending support members 26 and spaces such members 26 apart from each other such that members 26 remain parallel to each other. Members 52, 54, 56 take the shape of an inverted U in section and include bracing 58, 60, shown in FIG. 7. Bracing 58 extends widthwise or from side face to side face of the members 52, 54, 56. Bracing 60 extends lengthwise such as between bracing members 58 and between bracing 58 and a cylindrical receptor 62 that frictionally engages the upper end or upper end portion of lower vertically extending support member 26. Members 52, 54, 56 are one-piece and integral with bracing 58, bracing 60 and cylindrical receptors 62.

Upper barrier section 18 includes first, second and third upper horizontally extending support members 64, 66, 68. Members 64, 66, 68 are preferably aligned with each other in a straight line. Members 66 and 68, tied together with extension 100, are raised and lowered together when pinchers 86 are operated. Member 64 is raised and lowered independently of members 66 and 68, regardless of whether latch 102 is engaged or disengaged.

Each of the upper vertically extending support members 27 is now described more particularly. Members 64 and 66 are disposed on outer ends of the barrier 12 and have outer cylindrical tubes 70, 72 depending therefrom. Tubes 70, 72 slide vertically inside of respective tubes 36, 38 of lower barrier section 16. Members 64, 66 further have inner gate confronting tubes 74, 76 depending therefrom. Tubes 74, 76 are rectangular in section and slide vertically inside of respective tubes 32, 34 of lower barrier section 16. Member 68 have outer tubes 78, 80 depending therefrom. Tubes 78, 80 are generally square in section and slide vertically inside of respective tubes 44 and 46. Member 68 further includes a set of four cylindrical tubes 82 depending therefrom. Tubes 82 slide vertically inside of tubes 48. Tubes 78, 80, 82 can be referred to as gate vertically extending support members.

In other words, upper barrier section 18 includes a set of upper vertically extending support members 70, 72, 74, 76, 78, 80 and 82 engaged to, such as by welding, their respective upper horizontally extending support members 64, 66, 68. These upper vertically extending support members 70, 72, 74, 76, 78, 80 and 82 are generally referred to as upper vertically extending support members 27. The lower vertically extending support members 32, 34, 36, 38, 44, 46 and 48 are generally referred to as lower vertically extending support members 26.

Each of the upper and lower vertically extending support members 26, 27 is a shaft in the nature of a tube or rod and is preferably a tube to minimize barrier weight. Upper vertically extending support members 27 slideably engage their respective lower vertically extending support members 26 so as to slideably engage the lower barrier section 16 to the upper barrier section 18.

As shown in FIG. 7, some of the upper open ends 28 of lower vertically extending support members 26 include an insert or sleeve 84 for engaging its respective upper vertically extending support members 27. Sleeve 84 may include a relatively wide annular integral portion that rests upon the top of vertically extending support member 26 and a relatively narrow annular integral portion that extends in an elongated fashion below the relatively wide annular integral portion. Sleeve 84 spaces the paired lower and upper vertically extending support members 26 and 27 from each other such that the members 26 and 27 do not rub against one another. The vertically running opening in sleeve 84 has a surface that is manufactured or coated or that has a composition to be slippery such that members 26 and 27 are readily slideable relative to each other. Sleeve 84 is fixed within the open end 28 in a rigid or friction fit fashion such that sleeve 84 does not pop or ride out of open end 28 when the members 26 and 27 slide relative to each other.

Figure 3:
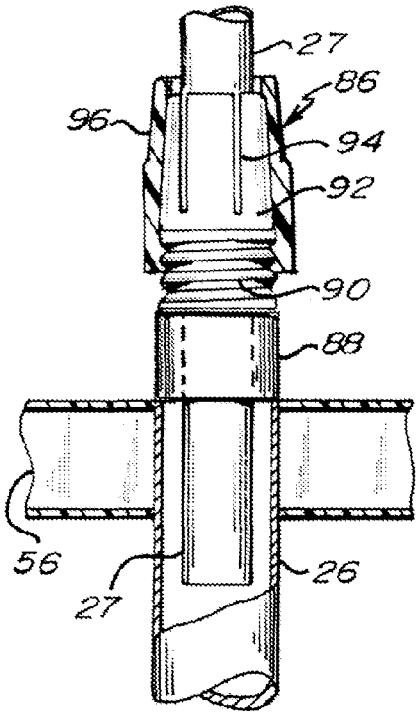
FIG. 3 is a detail, side, partially section view, at lines 3-3 of FIG. 1, of a quick release connection or pincher for one pair of vertically extending support members of the height adjustable barrier of FIG. 1.

Sleeve 84 is not utilized where a pincher 86 is used. As shown in FIG. 3, pincher 86 includes a cylindrical first portion 88 that frictionally fits upon an upper end of one of the lower vertically extending support members 26, namely, tubes 36, 72 and one of the tubes 48. Each of these vertically extending support members 36, 72, 48 extends a short way beyond the upper face of its respective medial horizontal support member 52, 54, 56 to permit such cylindrical portion 88 to be capped upon its upper end. At this point, it should be noted that the upper ends of the other lower vertically extending support members 26 terminate within the medial horizontal support member 52, 54, 56, as shown in FIG. 7. Cylindrical first portion 88 includes, in the nature of sleeve 84, a vertically extending through opening that receives upper vertically extending support member 27 in a slippery sliding fashion.

Pincher 86 further has a threaded second portion 90 extending upwardly and integrally from cylindrical first portion 88. Pincher 86 further includes a slotted tapered third portion 92 extending upwardly and integrally from threaded second portion 90. Third portion 92 includes a set of four vertically extending slots 94 disposed at ninety degrees relative to each other. Pincher 86 further includes a pinching collar 96 rotatably mounted on vertically extending support member 27. Pinching collar 96 has inner threads that engaged threaded second portion 90 and further includes a tapered inner surface that circumferentially engages tapered slotted portion 92 to reduce the width of slots 94 and thus the diameter of portion 92 such that portion 92 circumferentially grabs and frictionally holds member 27 relative to member 26. The tapered features of pinching collar 96 and third portion 92 permit a fixing of members 26 and 27 with each other to a relatively greater or lesser degree in an incremental manner such that, for example, the height of the upper barrier section 18 can be temporarily set with a medium degree of drag produced by slotted portion 92. Then, when the desired height is ascertained, the pinching collar 96 is fully turned such that slotted portion 92 produces a relatively high amount of drag to a point where the upper and lower barrier sections 16, 18 are locked relative to each other.

Pincher 86 controls the length of insertion of member 27 into member 26. Pincher 86 and its portions 88, 90, 92 include a through opening that functions in the nature of sleeve 84. Pinching collar 96 and second portion 90 include interacting helical threads. Slot 94 can be referred to as a generally axially extending slot. Slot 94 permits width-wise expansion and contraction or radial expansion and contraction or diametrical expansion and contraction of the slotted portion 92. Portion 92 is contracted when pinching collar 96 is threaded onto portion 90. The inner through opening of pinching collar 96 is tapered so as to decrease in radius from a lower portion to an upper portion. With such a tapering, portion 92 is incrementally contracted or squeezed to as to incrementally apply greater and greater pressure upon upper vertically extending support member 27 when pinching collar 96 is screwed onto portion 90. When pinching collar 96 is screwed off portion 90, portion 92 incrementally expands and the engagement between portion 92 and vertically extending support member 27 is loosened such that the lower and upper vertically extending support members 26 and 27 slide relatively freely relative to each other. Slot 94 is open ended and runs out of an upper end of portion 92.

Barrier 12 includes the gate 30. Gate 30 includes a portion of the lower barrier section 16 and a portion of the upper barrier section 18. More specifically, gate 30 includes the lower horizontally extending gate support member 42, the upper horizontally extending support member 68, gate end vertically extending support member 44, gate end vertically extending support member 46, vertically extending square gate tubes 78 and 80 that slide vertically in support members 44 and 46 respectively, medial horizontally extending support member 56, four gate inner cylindrical and tubular support members 48, four inner cylindrical tubes 82 sliding vertically in the support members 48, and one or more pinchers 86.

Gate 30 is pivotally engaged via the lower horizontally extending gate support member 42 to the lower horizontally extending support member 20 at a location 98 near the juncture of the support member 42 and gate end support member 46. Gate 30 is pivotally engaged via upper horizontally extending support member 68 to an extension or strip 100 protruding from upper horizontally extending support member 66. Swinging of the gate 30 extends to one side of the barrier 12 only. Swinging of the gate 30 to the other side is prevented by tab 50 that confronts a side of the lower horizontally extending support member 20. In other words, the barrier 12 generally defines a plane and the gate 30 swings out of the plane to one side of the plane, and back into the plane, but not to the other side of the plane, since the gate 30 is restricted by the tab 50 hitting the side of the lower horizontally extending support member 20.

Gate 30 further includes a latch 102 having generally four parts. Latch 102 includes a body 104 that is rigidly secured to upper horizontally extending support member 68, vertically extending square tube 78 and its adjacent cylindrical tube 82. Latch 102 further includes a lock 106 that slidingly engages upper horizontally support member 68. Latch 102 further includes a handle arm 108 that pivotally engages the body 104. The latch 102 further includes a generally U-shaped piece 110 that captures both sides of a portion of vertically extending support member 74 and a portion of horizontally extending support member 64. U-shaped piece 110 slidingly engages the body 104 and is drawn to and away from members 64, 74 by handle arm 108 that includes tabs that ride in vertically oriented slots formed in U-shaped piece 110. It can be appreciated that U-shaped piece 110 has a length slightly longer on one side than an opposite side such that U-shaped piece 110, even when fully drawn in by handle arm 108, remains in a confronting position with one side of member 64 and one side of member 74 (which sides are coplanar) such that U-shaped piece 110 performs an upper confronting function in the manner (and on the same side of the barrier 12) that tab 50 performs a lower confronting function. Lock 106 via an upper ridge normally prevents a swinging upwardly of handle arm 108. To operate handle arm 108, lock 106 is slid away from body 104 and then the handle arm 108 can be swung upwardly.

Figure 4:
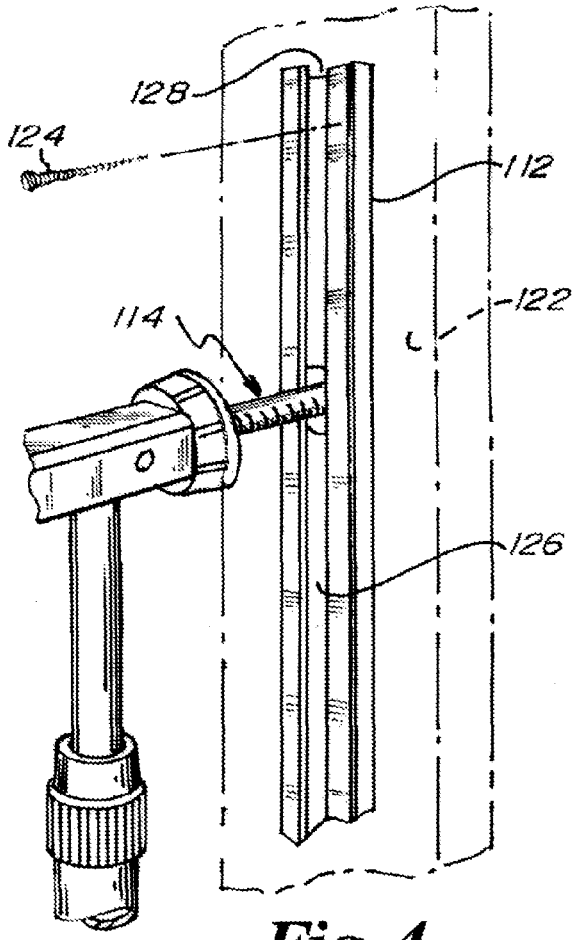
FIG. 4 is a perspective, detail view of an end portion of the gated height adjustable barrier of FIG. 1 engaging a track mounted on a door frame or frame of a point of access.
Figure 5:
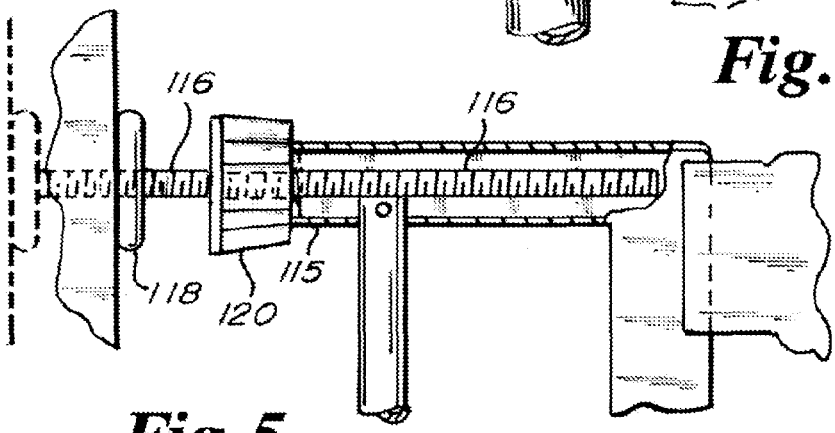
FIG. 5 is a detail, side, partially section view, at lines 5-5 of FIG. 1, of the upper end portion of the barrier of FIG. 1 and further shows how the barrier can engage relatively narrow points of access or relatively wide points of access.

As shown in FIGS. 4 and 5, barrier 12 further includes a guide track or slide 112 and a rider or upper extension 114 extending from both of the ends 115 of horizontally extending support members 64, 66. Rider or extension 114 includes a threaded shaft 116 having rigidly affixed thereto a rider head or slide head or disk 118 such that turning of the head 118 turns the shaft 116. Shaft 116 is threadingly engaged with an opening in the ends 115 of the horizontally extending support members 64, 66 such that the head 118 can be set at greater or lesser distances from the ends of the horizontally extending support members 64, 66. Shaft 116 turns on an axis common with the axis of the horizontally extending support members 64, 66. Rider 114 further includes a relatively large hand manipulated locking nut 120 that threadingly engages the shaft 116. Nut 120, when turned and one face is set against end 115, or when turned and the other face is set against track 112, rigidly fixes shaft 116 from being turned and thereby sets the head 118 at a given distance from end 115.

Track 112 is mounted on a wall or other vertical surface 122 via one or more pin connectors 124. Track 112 is generally C-shaped and includes a slot 126 for reception of the shaft 116. Slot 126 has a width greater than or equal to the diameter of the shaft 116 and less than the diameter of the head 118 so as to retain the head 118 in the track or guide member 112 and, at the same time, permit smooth vertical sliding of the head 118 in the track 112. Track 112 and slot 126 have an open upper end 128.

As shown in FIG. 1, barrier 12 further includes the horizontally adjustable lower extension 25. This can also be referred to as a pressurizing extension 25. Extension 25 includes the structure shown in FIG. 5. In other words, extension 25 includes the threaded shaft 116 having rigidly affixed thereto a head or disk 118 such that turning of the head 118 turns the shaft 116. Shaft 116 is threadingly engaged with an opening in ends of the lower horizontally extending support member 20 such that the head 118 can be set at greater or lesser distances from the ends of the lower horizontally extending support member 20. Shaft 116 turns on an axis common with the axis of the lower horizontally extending support member 25. Extension 25 further includes the relatively large hand manipulated locking nut 120 that threadingly engages the shaft 116. Nut 120 is first turned against the inner face of head 118 such that the head 118 can be turned or screwed inwardly or outwardly. By turning head 118 such that the length of extension 25 is extended, lower horizontal support member 20 can be pressure mounted between two walls 112 when both heads 118 are turned into and against both walls 112. The relatively large roughened circumference of nut 120 allows for a relatively easy fixing, under pressure, of the heads 118 and hence the lower portion of the barrier 12 between two vertical surfaces 112. Then, if desired, the nut 120 can be turned back the other way to fix the other face of the nut 120 against the end of the lower horizontal support member 20 to lock the shaft 116 or fix the shaft 116 from turning.

It should be noted that, if desired, the lower barrier section 16 may be engaged to vertical surface 122 with a guide track or slide 112 and a rider or upper extension 114.

The barrier extension 24 is shown in FIG. 6. This barrier extension 24 includes a lower horizontally extending support member 132, a medial horizontally extending support member 134, and a set of three vertically extending support members or vertically running cylindrical tubes 136 fixed between the members 132, 134. Barrier extension 24 further includes an upper horizontally extending support member 138 with a set of three vertically extending support members or vertically running cylindrical tubes 140 depending therefrom. Tubes 140 slide vertically in tubes 136. A pincher 86 is engaged between the pair of middle tubes 136, 140 and the other two pairs of tubes 136, 140 include the sleeve 84. Barrier extension 24 further includes a lower receptor 142 and an upper receptor 144 extending respectively from the lower and upper horizontally support members 132, 138. Receptors 142, 144 are C-shaped and engage the upper and side faces of end portions of the lower and upper horizontally extending support members 20 and 64 (or 66) of main barrier 12 with pin connectors 22.

FIG. 6 further shows that barrier 12 can include upper and lower pressurizing extensions 25 on each of the upper and lower horizontally extending support members 138, 132 (or on members 64 and 20, or on members 66 and 20). That is, the track or guide member 112 need not be included such that barrier 12 utilizes pressurizing extensions 25 at four locations, with two pressurizing extensions 25 disposed on each of the sides (or ends) of the barrier 12, where one each side (or end) each of a lower and upper pressurizing extension 25 is used. This is in contrast to the preferred embodiment, where a pair of pressurizing extensions 25 are used for a lower engagement of the lower barrier section 16 to a pair of vertical surfaces 122 and where a pair of track 112 and rider 114 combinations are used for an upper engagement of the upper barrier section 18 to a pair of vertical surfaces 122.

Figure 2:
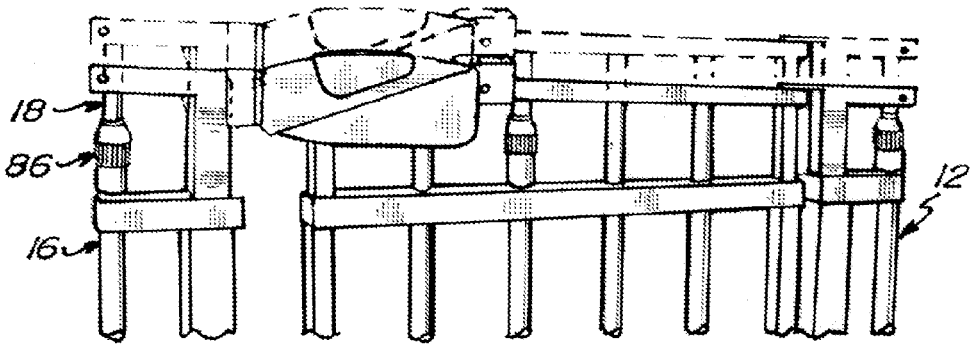
FIG. 2 is a perspective, partial view of the gated height adjustable barrier of FIG. 1, showing raised and lowered positions of the upper barrier section.

In operation, tracks 112 are fixed to opposing vertical surfaces 122. Then shafts 116 are turned in or out to increase or decrease an effective length (or width) of barrier 12 such that the respective heads 118 can drop into respective open ends 128. Then locking nuts 120 are fixed to either the track 112 or end 115 to fix the shafts 116 at the appropriate lengths. Then, or prior to the time of adjusting the length of shafts 116, the lower horizontal extensions 25 are turned out so as to fix the lower barrier section 16 securely in place between the opposing vertical surfaces 122. Then, as shown in FIG. 2, the pinchers 86 are loosened to permit sliding of the upper barrier section 18 relative to the lower barrier section 16. During this sliding, the heads 18 ride up and down in the tracks 112. At the desired height, the pinchers 86 are tightened. The pinchers 86 are tightened when the upper barrier section 18 is in a raised position, such as shown in FIG. 2 in phantom, when the upper barrier section 18 is in a lowered position, such as shown in FIG. 2, and when the upper barrier section 18 is at any position between the shown raised and lowered positions. Gate 30 is openable and closeable when the upper barrier section 18 is in any raised, lowered, or in-between position.

It should be noted that gate 30 includes a latching end or support member 44 that swings in an arc. Upper vertically extending support member 32 of the upper barrier section 18 opposes the latching end 44. The height adjustable barrier 12 includes an operating configuration, such as between vertical surfaces 122, and a storable configuration such as where the barrier 12 is laid flat and is not engaged between any two vertical surfaces 122. The latching end 44 is spaced a given distance from the upper vertically extending support member 32 in each of the operating and storable configurations such that the gate 30 is not a pressure gate. A pressure gate may be a pressure gate where a barrier section, with which a gate barrier section swings into and out of engagement, has vertically extending support members slightly off parallel with vertically extending support members of the gate barrier section. Here, upper horizontally extending support member 64, medial horizontally extending support member 52, lower horizontally extending support member 20, vertically extending support members 32, 36, 70, and 74 can be referred to an end barrier section. Such end barrier section has vertically extending support members 26, 27 that remain at all times parallel to the vertically extending support members 26, 27 of the gate barrier section 30 whether the barrier section 12 is fixed between two vertical surfaces 122 in an operating configuration or whether the barrier section 12 is in a stored configuration and laid flat.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A gated height adjustable barrier, comprising:

a) a lower barrier section comprising a lower horizontally extending support member and a lower set of lower vertically extending support members;

b) an upper barrier section comprising an upper horizontally extending support member and an upper set of upper vertically extending support members, with each of the upper vertically extending support members aligned with and slideably engaging one of the lower vertically extending support members;

c) a gate in the barrier, with the gate being formed by a portion of the lower barrier section and a portion of the upper barrier section; and d) wherein the upper horizontally extending support member is fixable at different heights relative to the lower horizontally extending support member.

2. The gated height adjustable barrier of claim 1, wherein said gate comprises:

a) a gate lower barrier section comprising a lower horizontally extending support member and a lower set of lower vertically extending support members; and b) a gate upper barrier section comprising an upper horizontally extending support member and an upper set of upper vertically extending support members, with each of the said upper vertically extending support members of said gate upper barrier section aligned with and slideably engaging one of the lower vertically extending support members of said gate lower barrier section.

3. The gated height adjustable barrier of claim 2, and further comprising a medial horizontally extending support member, with said medial horizontally extending support member being engaged to one of the gate lower and upper barrier sections and being engaged to and spacing apart the vertically extending support members of said one of the gate lower and upper barrier sections.

4. The gated height adjustable barrier of claim 1, and further comprising a pincher having a first portion fixed on one of an upper and lower vertically extending support member, wherein said first portion of the pincher is slideable relative to and circumferentially grabs the other of said upper and lower vertically extending support member to permit and stop sliding of said upper and lower vertically extending support members relative to each other, and wherein said pincher includes a second portion that circumferentially engages the first portion to increase and decrease a diameter of the first portion.

5. The gated height adjustable barrier of claim 1, wherein said one of said lower and upper vertically extending support members comprises a tube and wherein the other of said lower and upper vertically extending support members is slideable in said tube.

6. The gated height adjustable barrier of claim 1, wherein a sleeve is disposed between said lower and upper vertically extending support members that are aligned with each other, with the sleeve spacing said lower and upper vertically extending support members that are aligned with each other from each other in a radial direction, and wherein said sleeve includes an inner surface portion that is slippery to enhance slideability between said lower and upper vertically extending support members that are aligned with each other.

7. The gated height adjustable barrier of claim 1, and further comprising another lower barrier section and another upper barrier section, with said lower barrier sections being engaged to each other and with said upper barrier section being engaged with each other such that said gated height adjustable barrier can be extended in length.

8. The gated height adjustable barrier of claim 1, and further comprising a medial horizontally extending support member, with said medial horizontally extending support member being engaged to one of the lower and upper barrier sections and being engaged to and spacing apart the vertically extending support members of said barrier section, and with said medial horizontally extending support member being disposed between the upper and lower horizontally extending support members.

9. The gated height adjustable barrier of claim 1, wherein said gate includes a latching end that swings in an arc, wherein one of the upper vertically extending support members of the upper barrier section opposes said latching end, wherein said height adjustable barrier includes an operating configuration and a storable configuration, and wherein said latching end is spaced a given distance from said upper vertically extending support member in each of the operating and storable configurations such that said gate is not a pressure gate.

10. The gated height adjustable barrier of claim 1, wherein said gated height adjustable barrier includes an operating configuration and a storable configuration, and wherein vertically extending support members of an end barrier section that is disposed outside of the gate remains parallel to vertically extending support members of the gate in each of the operating and storable configurations such that said gate is not a pressure gate.

11. The gated height adjustable barrier of claim 1 and further comprising a) a track, and b) an extension engaged between the track and the upper barrier section, wherein the track is mountable on a vertical surface, and wherein the extension includes an end slideable vertically in the track when the upper barrier section slides vertically relative to the lower barrier section.

12. The gated height adjustable barrier of claim 1 and further comprising a) a track, and b) an extension engaged between the track and the upper barrier section, wherein the track is mountable on a vertical surface, wherein the extension includes an end slideable vertically in the track when the upper barrier section slides vertically relative to the lower barrier section, and wherein the extension is adjustable in a length direction relative to said upper barrier section.

13. The gated height adjustable barrier of claim 1, wherein the gated height adjustable barrier is secured between two vertical surfaces, wherein the gated height adjustable barrier includes a track for mounting on at least one of the two vertical surfaces, wherein the upper barrier section includes an upper extension adjustable in a length direction relative to said upper barrier section such that said upper extension can reach out to and slide up and down in said track when the upper barrier slides up and down relative to the lower barrier section, and wherein the lower barrier section includes a lower extension adjustable in a length direction relative to said lower barrier section such that said lower extension can reach out to one of the vertical surfaces, with said lower extension being generally fixed at one location to fix the lower barrier section at generally one location while the upper barrier section is slideable up and down.

14. The gated height adjustable barrier of claim 1, wherein the gated height adjustable barrier is secured between two vertical surfaces, wherein the upper barrier section includes an upper extension adjustable in a length direction relative to said upper barrier section such that said upper extension can reach out to one of the vertical surfaces, with said upper extension being generally fixed at one location to fix the upper barrier section at generally one location, and wherein the lower barrier section includes a lower extension adjustable in a length direction relative to said lower barrier section such that said lower extension can reach out to one of the vertical surfaces, with said lower extension being generally fixed at one location to fix the lower barrier section at generally one location.

15. A gated height adjustable barrier, comprising:

a) a lower barrier section comprising a lower horizontally extending support member and a lower set of lower vertically extending support members;

b) an upper barrier section comprising an upper horizontally extending support member and an upper set of upper vertically extending support members, with each of the upper vertically extending support members aligned with and slideably engaging one of the lower vertically extending support members, with the upper horizontally extending support member being fixable at different heights relative to the lower horizontally extending support member;

c) a gate in the barrier, with the gate being formed by a portion of the lower barrier section and a portion of the upper barrier section; and d) a quick release connection between at least one vertically extending support member and the lower vertically extending support member with which said at least one vertically extending support member is aligned, wherein said quick release connection fixes the lower barrier section relative to the upper barrier section such that the lower barrier section is not slideable relative to the upper barrier section until the quick release connection is released.

16. The gated height adjustable barrier of claim 15, wherein said quick release connection comprises:

a) a first member fixed to one of said lower and upper vertically extending support members and having a threaded portion circumferentially engaging the other of said lower and upper vertically extending support members;

b) a second member rotatably engaged to one of said lower and upper vertically extending support members and having an inner portion threadingly engaging the threaded portion of the first member such that when the second member threadingly engages the first member, the first member squeezes the support member that the first member circumferentially engages to fix the lower and upper vertically extending support members relative to each other.

17. The gated height adjustable barrier of claim 16, wherein one of the threaded portion and inner portion is tapered such that the threaded portion is incrementally squeezed against the support member that the first member circumferentially engages.

18. A gated height adjustable barrier, comprising:

a) a lower barrier section comprising a lower horizontally extending support member and a lower set of lower vertically extending support members;

b) an upper barrier section comprising an upper horizontally extending support member and an upper set of upper vertically extending support members, with each of the upper vertically extending support members aligned with and slideably engaging one of the lower vertically extending support members, with the upper horizontally extending support member being fixable at different heights relative to the lower horizontally extending support member;

c) a gate in the barrier, with the gate being formed by a portion of the lower barrier section and a portion of the upper barrier section; and d) a medial horizontally extending support member, with said medial horizontally extending support member being engaged to one of the lower and upper barrier sections and being engaged to and spacing apart the vertically extending support members of said barrier section, and with the medial horizontally extending support member being disposed between the upper and lower horizontally extending support members.

19. The gated height adjustable barrier of claim 18, wherein said gate comprises:

a) a gate lower barrier section comprising a lower horizontally extending support member and a lower set of lower vertically extending support members;

b) a gate upper barrier section comprising an upper horizontally extending support member and an upper set of upper vertically extending support members, with each of the upper vertically extending support members of said gate upper barrier section aligned with and slideably engaging one of the lower vertically extending support members of said gate lower barrier section; and c) a gate medial horizontally extending support member engaged to one of the gate lower and upper barrier sections and is engaged to and spaces apart the vertically extending support members of said one of the gate lower and upper barrier sections.

* * * * *